United States Patent [19]

Mitzlaff et al.

[11] 3,941,666

[45] Mar. 2, 1976

[54] PROCESS FOR THE PREPARATION OF N-(α-ALKOXYETHYL)-CARBOXYLIC ACID AMIDES

[75] Inventors: Michael Mitzlaff, Bad Homburg; Horst Schnabel, Steinbach, Taunus, both of Germany

[73] Assignee: Hoechst Aktiengesellschaft, Frankfurt am Main, Germany

[22] Filed: July 18, 1974

[21] Appl. No.: 489,533

[30] Foreign Application Priority Data

July 20, 1973 Germany ..... 2336976

[52] U.S. Cl. ..... 204/79; 204/59 R; 204/72; 204/73 R

[51] Int. Cl.[2] C25B 3/02; C25B 3/10; C07C 103/30

[58] Field of Search ..... 204/59 R, 73 R, 73 A, 72, 204/79

[56] References Cited

UNITED STATES PATENTS

| | | | |
|---|---|---|---|
| 3,582,484 | 6/1971 | Dennison et al. | 204/79 |
| 3,652,430 | 3/1972 | Beck et al. | 204/72 |
| 3,756,928 | 9/1973 | Eisele et al. | 204/59 R |
| 3,787,299 | 1/1974 | Beck et al. | 204/59 R |

FOREIGN PATENTS OR APPLICATIONS

| | | | |
|---|---|---|---|
| 11,116 | 7/1963 | Japan | 204/79 |

*Primary Examiner*—F. C. Edmundson

*Attorney, Agent, or Firm*—Curtis, Morris & Safford

[57] ABSTRACT

N-(α-alkoxyethyl)-carboxylic acid amides of the (1), where $R^1$ is H or lower alkyl and $R^2$ is lower alkyl, are prepared by anodic alkoxylation of a N-acyl-α-aminopropionic acid neutralized at a rate of from 3 to 50 mole % with an alcohol $R^2OH$. The compounds are valuable intermediate products for the preparation of N-vinylcarboxylic acid amides which may be converted to water-soluble polymers having multiple technological properties.

11 Claims, 1 Drawing Figure

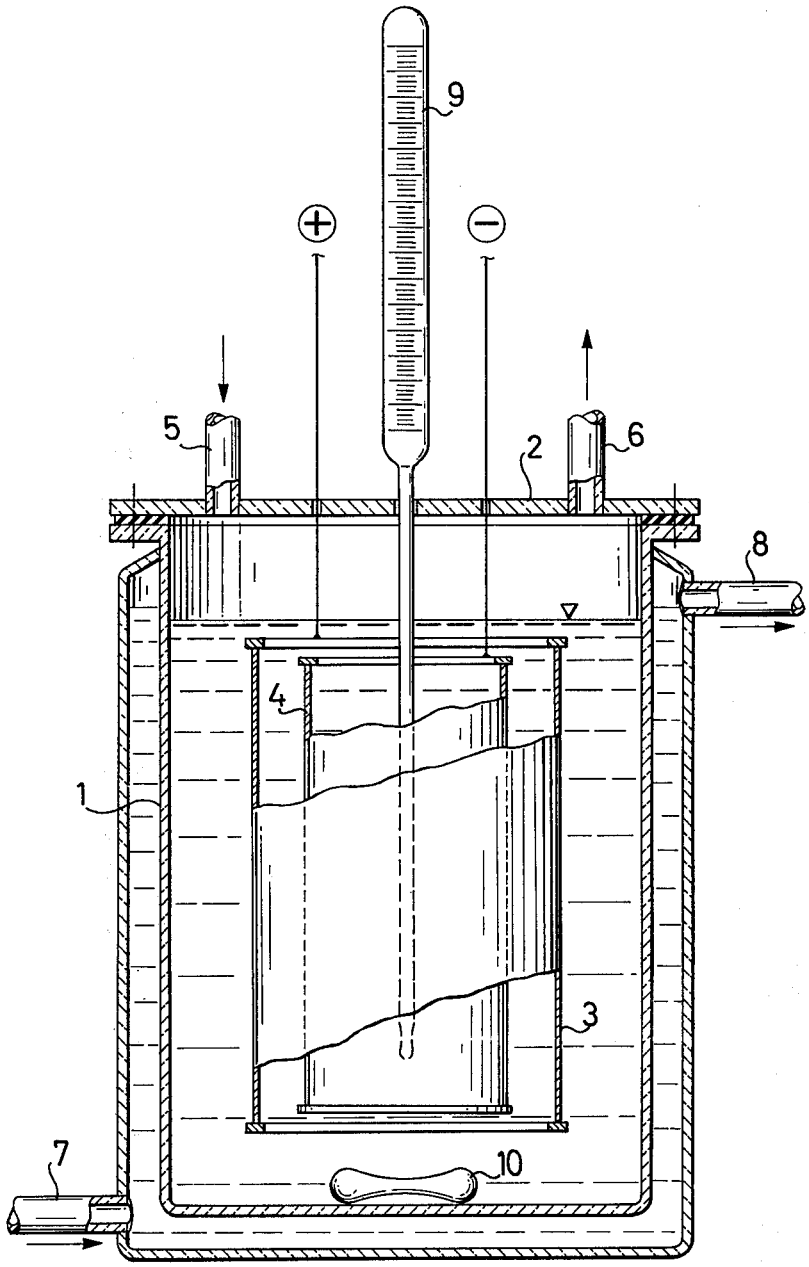
9
5
6
2
8
4
1
3
7
10

PROCESS FOR THE PREPARATION OF N-(α-ALKOXYETHYL)-CARBOXYLIC ACID AMIDES

It is known to obtain N-(α-methoxyethyl)-acetamide by converting 2% of N-acetyl-α-alanine to the sodium salt and electrolyzing the methanolic solution of this partially neutralized mixture; amounts of up to 15% of diamine, so-called Kolbe condensation product, being obtained as by-product in this process (see J. Chem. Soc. (1951), 2854 – 2858, or Quart. Rev. 6 (1952), 389). The energy yield of this anodic alkoxylation proceeding with splitting-off of $CO_2$, however, is entirely uneconomic for use in industrial practice, since at least 3- to 6-fold of the theoretically necessary current quantity of 2 Faradays per mole has to be passed through the electrolysis solution.

It is furthermore known that Kolbe condensation products are obtained in electrolysis cells having vibrating electrodes by electrolysis of methanolic solutions of optionally substituted carboxylic acids, for example aminocarboxylic acids having "protected" amino groups; the carboxylic acid used in this case being partially neutralized at a slightly elevated percentage of from 2 to 10% (German Offenlegungsschrift No. 1 643 693). However, α-amino acids are not cited as starting substances.

It is furthermore known that higher neutralization degrees have a favorable effect on the formation of Kolbe condensation products, and that therefore Kolbe syntheses are carried out at considerably higher neutralization degrees (from 10 to 30%) in cells containing non-vibrating electrodes, thus obtaining higher yields of Kolbe condensation products, and more current and energy efficiency (see Quart. Rev. 6 (1952), 380; F. Fichter, Organische Elektrochemie, p. 42, Dresden 1942); the electrolysis being generally carried out in aqueous solutions in these cases.

Surprisingly, it has now been found that, in modification of the known electrochemical processes for the preparation of Kolbe products, N-(α-alkoxyethyl)-carboxylic acid amides of the formula (1)

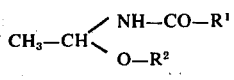

(1)

where $R^1$ is hydrogen or lower alkyl having preferably from 1 to 4 carbon atoms, especially methyl, and $R^2$ is lower alkyl having preferably from 1 to 4 carbon atoms, especially also methyl, are obtained with excellent yields and current efficiency by anodic alkoxylation of a partially neutralized N-acyl-α-aminopropionic acid of the formula (2)

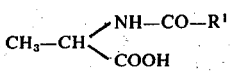

(2)

where $R^1$ is as defined above, in an alcoholic solution, a process which comprises electrolyzing the compounds of formula (2) converted to an alkali metal salt, preferably the sodium or potassium salt, to the extent of from 3 to 50 mole %, preferably from 5 to 20 mole %, with an alcohol of the formula (3)

$$R^2OH \quad (3),$$

where $R^2$ is as defined above, in a molar ratio of from 1 : 2 to 1 : 50, preferably from 1 : 5 to 1 : 30, especially from 1 : 10 to 1 : 20, at temperatures of from −10° to +100°C, preferably from 0° to 60°C, in an electrolysis cell containing static electrodes and stagnant or flowing electrolytes, and isolating the anodically formed alkoxylation product in known manner.

The required current quantity is from 2 to 6, preferably from 2 to 4, and especially from 2.2 to 3 Faraday per mole of N-acylated α-aminopropionic acid. The theoretically required current quantity is 2 Faraday per mole.

As N-acylated α-aminopropionic acids, there are used for example especially N-acetyl-α-alanine, N-propionyl-α-alanine or N-butyroyl-α-alanine. As alcohols, primary or secondary aliphatic alcohols having from 1 to 4 carbon atoms are used, for example methanol, ethanol, n-propanol, i-propanol, n-butanol or s-butanol; the primary alcohols, especially methanol or ethanol, being preferably employed.

The electrochemical alkoxylation with simultaneous decarboxylation of the starting component may be carried out continuously or batchwise. Batchwise electrolysis may for example be carried out in the electrolysis cell 1 as shown in the accompanying drawing. The cell 1 has a tightly fitting cover 2 through which the leads for the electrodes 3 and 4 are passed, and in which there are openings for feeding in the electrolysis solution 5, for the discharge of the reaction gases 6, and for introducing a thermometer 9. The opening for the discharge of the gases may be connected to a reflux condenser where vaporized quantities of the electrolysis mixture may be recondensed. The electrolysis cell has a jacket and may be connected to a heating or (liquid) cooling cycle by means of the inlet 7 and outlet 8 pipes. The temperature of the electrolysis solution is measured by means of a thermometer 9 or a thermocouple. Both the electrodes, the anode 3 and the cathode 4 are mounted at a distance of from 0.5 to 50 mm, preferably from 1 to 15 mm, from each other. As electrode material, nets or sheets of palladium or platinum, or metal electrodes coated with noble metals, preferably titanium electrodes, metal electrodes coated with mixed oxides (as anodes), preferably titanium anodes, nickel or nickel containing alloys, or slotted or unslotted graphite plates are used. A net-like shape of the electrodes is especially advantageous, since carbon dioxide and hydrogen gases developed during the electrolysis may be more easily discharged, and the gas current thus formed ensures a homogeneous intermixture of the electrolysis solution. The electrodes may also be arranged horizontally instead of vertically. It is also possible to provide several electrode pairs in a block-like combination of angular or non-angular electrodes having capillary slots. During the electrolysis, the solution is thoroughly intermixed by means of an agitator, for example a magnetic agitator 10, or by pump-circulation, especially in the case of block-like electrode combinations. Since the space-time yield is thereby increased, it is advantageous to operate on the basis of flowing electrolytes when continuous-flow cells and packed-bed electrodes of bipolar connection in mixtures of conductive and nonconductive particles of identical grain in a ratio of from 1 : 2 to 1 : 4 are used; the conductive particles consisting of the abovementioned electrode materials (with the exception of the titanium particles coated with mixed oxides), preferably of graphite. More favorable energy and space-time yields still are obtained when continuous-flow cells and layer-bed electrodes are employed; the layers consisting of conductive particles of the above-mentioned electrode materials (with the exception of the titanium particles coated with mixed oxides), preferably of graphite, which particles have identical grain. The layers in this case are separated by porous nonconductive inorganic or organic materials in the form of thin plates, fabrics, meshes, felts or fleeces, for example glass fiber fleece or polypropylene mesh, in such a manner that these materials are in a vertical or parallel position with respect to the electric field lines.

When the process is carried out continuously, a further opening for the continuous pump-circulation of the electrolysis solution is provided in the cover 2 of the electrolysis vessel 1. A certain portion of the pump-circulated electrolysis solution is continuously separated for work-up of the product. After examination of the electrolysis solution with respect to the ratio of desired reaction product to starting substance by means of nuclear resonance spectroscopy or gas chromatography, the solution is worked up in known manner. The starting substances recovered by distillation, after having been adjusted to the molar ratio used, are returned to the continuously pump-circulated electrolysis solution, simultaneously with the required amount of a base or a base former.

The electrolysis is generally carried out at normal pressure, but reduced pressure is also admissible. In order to avoid the formation of explosive gas mixtures of hydrogen and air, it is advantageous to operate with addition of an inert gas, for example nitrogen.

The electrolysis solution in accordance with the present invention is an alcoholic solution of partially neutralized N-acyl-$\alpha$-alanine. Partial neutralization is obtained by adding a base or a base former, whereby neutralization degrees of from 3 to 50%, preferably from 5 to 20%, may be obtained. As bases or base formers, there are employed for example alkali metal hydroxides per se or in alcoholic solution, preferably sodium or potassium hydroxide, or alkali metals, preferably sodium or potassium, or alkali metal alcoholates, preferably sodium or potassium methylate (in methanol as solvent) or sodium or potassium ethylate (in ethanol as solvent). The base or base former is added after the N-acyl-$\alpha$-alanine is dissolved in the alcohol, but the sequence may also be inverted. It is not necessary to exclude water completely from the electrolysis, since small amounts of moisture do not adversely affect the course of the reaction in accordance with the present invention; however, large amounts of water should not be present.

The process may be optimized with respect to energy or product yield by elevating the conversion rate of N-acyl-$\alpha$-alanine, for example up to more than 90%, which is very advantageous for the work-up of the electrolysis solution. Generally, therefore, the starting substance is electrolyzed until it is practically completely converted, so that a subsequent separation from the reaction product is not necessary.

After the desired current quantity is passed through the vessel, the electrolysis current is switched off, the discharged electrolysis product is neutralized and worked up by distillation in known manner. The reaction product of the electrolysis is examined with respect to its purity by means of nuclear resonance spectroscopy or gas chromatography.

As operating temperature for the electrolysis, a temperature is chosen which is below the boiling temperature of the alcohol and above the melting point of the electrolysis solution. Generally, the temperatures are from about −10°C to +100°C, preferably from about 0°C to 60°C.

The current density is adjusted to values of from 2 to 100 A/dm$^2$, preferably from 4 to 80 A/dm$^2$. Lower current densities are possible but they slow down the formation of product.

The N-$\alpha$-alkoxyethyl-carboxylic acid amides prepared according to the electrochemical process of the invention are valuable intermediate products for the preparation of N-vinylcarboxylic acid amides which may be converted to water-soluble polymers having multiple technological properties (see Ullmanns Encyklopadie der Techn. Chemie, 3rd edition, volume 14, pp. 261 – 264).

The following examples illustrate the invention.

Comparative EXAMPLE 1 (electrolysis conditions according to the indications of J. Chem. Soc. (1951), pp. 2855/2856)

An electrolysis cell according to the drawing having a capacity of 100 ml and provided with a cover and a reflux condenser is charged with a mixture of 26.1 g of N-acetyl-$\alpha$-alanine and 95.0 g of methanol, in which mixture 2% of the N-acetyl-$\alpha$-alanine is neutralized with sodium. Two concentrically arranged cylindrical platinum nets having 225 meshes per cm$^2$, a diameter of 10 and 30 mm, respectively, and a height of 50 mm are immersed in the solution as electrodes, the cathode being in the interior. The temperature is maintained at 0°C during the electrolysis. Agitation is carried out by means of a magnetic agitator at 30 to 35 r.p.m.

After switching on the electrolysis d.c., the anode current density is 4.5 A/dm$^2$. After a current quantity of 6 Faraday per mole of N-acetyl-$\alpha$-alanine has been passed through the cell, the current is switched off. The calculated average cell voltage is 75.2 volts.

After work-up of the electrolysis solution in known manner (neutralization of the solution and distillation), 19.5 g of N-($\alpha$-methoxyethyl)-acetamide (melting point 35° – 40°C, $n_D^{35} = 1.4339$) are obtained which correspond to a product yield of 83.7%, a current efficiency of 27.9%, and an energy yield of 8.1 g/kWh, that is, an energy expenditure of 123.5 kWh/kg.

Comparative EXAMPLE 2

Operations are carried out according to Comparative Example 1, with the difference of switching off the electrolysis current after having passed through the cell a current quantity of 2 Faraday per mole. An average cell voltage of 73.6 volts is calculated. After work-up of the reaction mixture, 7.5 g of N-($\alpha$-methoxyethyl)-acetamide are obtained, which correspond to a product yield of only 31.7%, a current efficiency of 31.7%, and an energy yield of 9.5 g/kWh, that is, an energy expenditure of 105.2 kWh/kg.

This test shows that there are no advantages over Comparative Example 1 even by drastically reducing the current quantity. On the contrary, the product yield drops considerably (to 31.7%), while the values of current and energy efficiency and energy expenditure show an insignificant improvement only.

| Base or base former | Average cell voltage [V] | N-(α-methoxyethyl)-acetamide yield of material [%] | current [%] | energy [g/kWh] | energy expenditure [kWh/kg] |
|---|---|---|---|---|---|
| lithium | 24.9 | 69.3 | 23.1 | 20.4 | 49.1 |
| sodium[1] | 28.1 | 85.4 | 28.5 | 22.1 | 45.2 |
| potassium | 21.5 | 90.3 | 30.1 | 30.6 | 32.7 |
| NaOH | 23.5 | 86.7 | 28.9 | 27.5 | 36.4 |
| KOH | 23.2 | 91.5 | 30.5 | 28.7 | 34.8 |

[1]Values taken from Example 1

EXAMPLE 1

The electrolysis cell as described in Comparative Example 1 is charged with a mixture of 26.1 g of N-acetyl-α-alanine and 95.0 g of methanol; 20% of the N-acetyl-α-alanine being neutralized by means of sodium. The temperature is maintained at 0°C during the electrolysis. Agitation is carried out by means of a magnetic agitator at 30 to 35 r.p.m. After switching on the electrolysis current, the anode current density is 5.4 A/dm². After passing the 3-fold theoretical current quantity, relative to the required 2 Faraday per mole of N-acetyl-α-alanine, through the electrolysis solution as in Comparative Example 1, the current is switched off. An average cell voltage of 28.1 volts is calculated. Work-up of the electrolysis solution in known manner (neutralization of the solution and distillation) yields 20.0 g of pure N-(α-methoxyethyl)-acetamide. This corresponds to a product yield of 85.4%, a current efficiency of 28.5%, and an energy yield of 22.1 g/kWh, that is, an energy expenditure of 45.2 kWh/kg.

EXAMPLE 2

The process is carried out according to the conditions indicated in Example 1, but equivalent amounts of different bases or base formers are used for a 20% partial neutralization of the N-acetyl-α-alanine used. The results obtained are listed in the following Table.

EXAMPLE 3

The process is carried out according to the conditions indicated in Example 1, but potassium is used as base former in equivalent amount, and the neutralization degree of N-acetyl-α-alanine is varied. The results obtained are listed in the following Table.

| Neutralization degree [%] | Average cell voltage [V] | N-(α-methoxyethyl)acetamide yield of material [%] | current [%] | energy [g/kWh] | energy expenditure [kWh/kg] |
|---|---|---|---|---|---|
| 2 | 76.7 | 83.0 | 27.6 | 7.8 | 127.5 |
| 5 | 29.5 | 90.7 | 30.2 | 22.3 | 44.8 |
| 10 | 25.8 | 89.0 | 29.7 | 25.3 | 39.5 |
| 20[1] | 21.5[1] | 90.3[1] | 30.1[1] | 30.6[1] | 32.7[1] |
| 50 | 15.2 | 91.3 | 30.4 | 63.3 | 15.8 |

[1]Values taken from Example 2

EXAMPLE 4

The process is carried out according to the conditions indicated in Example 1, but potassium is used as base former in equivalent amount, and the current quantity passed through the solution per mole of N-acetyl-α-alanine is varied from 6 to 2 Faraday/mole.

The results obtained are listed in the following Table.

| Current quantity [Faraday/mol] | Average cell voltage [V] | N-(α-methoxyethyl)-acetamide yield of material [%] | current [%] | energy [g/kWh] | energy expenditure [kWh/kg] |
|---|---|---|---|---|---|
| 2.0 | 23.2 | 89.4 | 89.4 | 82.0 | 12.2 |
| 2.2 | 23.2 | 90.0 | 81.8 | 82.0 | 12.2 |
| 2.5 | 23.8 | 94.3 | 75.4 | 65.8 | 15.2 |
| 3.0 | 21.6 | 90.8 | 60.5 | 59.9 | 16.7 |
| 4.0 | 22.0 | 92.5 | 46.3 | 43.9 | 22.8 |
| 6.0 | 21.5[1] | 90.3[1] | 30.1[1] | 30.1[1] | 32.7[1] |

Values taken from Example 2

EXAMPLE 5

The process is carried out according to the conditions indicated in Example 1, but potassium is used as base former in equivalent amount, and the molar ratio of methanol to N-acetyl-α-alanine is varied from 5 : 1 to 15 : 1. Furthermore, the current quantity passed through the solution is only 2 Faraday per mole of N-acetyl-α-alanine. The results obtained are listed in the following Table.

| Molar ratio methanol to N-acetyl-α-alanine | Average cell voltage | N-(α-methoxyethyl)-acetamide yield of material | current | energy | Energy expenditure |
|---|---|---|---|---|---|
| | [V] | [%] | [%] | [g/kWh] | [kWh/kg] |
| 5 : 1 | 37.4 | 89.4 | 89.4 | 52.6 | 19.0 |
| 10 : 1 | 22.6 | 90.6 | 90.6 | 94.3 | 10.6 |
| 15 : 1[1] | 23.2[1] | 89.4[1] | 89.4[1] | 82.0[1] | 12.2[1] |

[1]Values taken from Example 4

EXAMPLE 6

The process is carried out according to the conditions indicated in Example 1, but potassium is used as base former in equivalent amount, and the average cell temperature is varied. Furthermore, the current quantity passed through the solution is 4 Faraday per mole of N-acetyl-α-alanine, and the current density is 10 A/dm². The results obtained are listed in the following Table.

| Average cell temperature [°C] | Average cell voltage [V] | N-(α-methoxyethyl)-acetamide yield of material [%] | current [%] | energy [g/kWh] | Energy expenditure [kWh/kg] |
|---|---|---|---|---|---|
| 20 | 21.1 | 91.5 | 45.8 | 47.4 | 21.1 |
| 40 | 18.5 | 94.0 | 47.0 | 55.6 | 18.0 |
| 60 | 17.1 | 91.0 | 45.5 | 58.1 | 17.2 |

EXAMPLE 7

In an electrolysis cell according to Example 1, wherein, however, two graphite plates having vertical slots of a width of 2 mm (thickness 4 mm, width 30 mm, height 60 mm, distance 4 mm) are used as electrodes, the electrolysis is carried out under the conditions indicated in Example 1, but potassium is used as base former in equivalent amount, and the molar ratio of methanol to N-acetyl-α-alanine is 5 : 1, the current quantity is 2.5 Faraday per mole of N-acetyl-α-alanine and the current density is 10 A/dm². After the usual work-up of the reaction mixture, the N-(α-methoxyethyl)-acetamide is obtained with a product yield of 88.3%, a current efficiency of 70.7%, an energy yield of 104.2 g/kWh and an energy expenditure of 9.6 kWh/kg of product at an average cell voltage of 14.8 volts.

EXAMPLE 8

A methanolic solution of 393.0 g of N-acetyl-α-alanine (molar ratio methanol: N-acetyl-α-alanine = 30 : 1), in which the N-acetyl-α-alanine is partially neutralized to the extent of 20% by means of NaOH, is electrolyzed for 1 hour in a layerbed cell with flowing electrolytes at a current density of 76.4 A/dm² and an average cell temperature of 55°C. The layerbed cell used consists of a screwed cylinder made from polyacetal having an inner diameter of 145 mm, which contains current conductor electrodes of perforated graphite plates (thickness 20 mm, hole diameter 2 mm, total number of holes 1027, plate distance 25 mm) and 15 layers of graphite granules (grain size 1.25 to 1.50 mm) between these plates, as well as intermediate layers of porous glass fiber fleece (thickness 0.3 mm).

After the usual work-up, the N-(α-methoxyethyl)-acetamide is obtained with a product yield of 81.5%, an energy yield of 70.5 g/kWh at an average cell voltage of 270 volts and an energy expenditure of 14.2 kWh/kg of product.

EXAMPLE 9

In an electrolysis cell according to Example 1, a solution of 15.0 g of N-formyl-α-alanine and 82.1 g of methanol, partially neutralized by NaOH to the extent of 5%, is electrolyzed at a current density of 5.4 A/dm² and a temperature of 0°C with agitation by means of a magnetic agitator at 30 to 35 r.p.m. After a current quantity of 0.307 Faraday is passed through the solution and the electrolysis solution is worked up in known manner, 11.5 g of N-(α-methoxyethyl)-formamide (boiling point 66.5°C/1.3 mbar; $n_D^{25}$ = 1.4344) are obtained, which corresponds to a product yield of 87.3% and a current efficiency of 72.8%. At an average cell voltage of 12.9 volts, an energy expenditure of 9.2 kWh/kg of product can be calculated from the above data.

EXAMPLE 10

In an electrolysis cell according to Example 1, a solution of 19.7 g of N-acetyl-α-alanine and 103.5 g of ethanol, partially neutralized by means of potassium to the extent of 20%, is electrolyzed at a current density of 5.4 A/dm² and a temperature of 0°C with agitation by means of a magnetic agitator at 30 to 35 r.p.m. After a current quantity of 0.358 Faraday is passed through the cell and the electrolysis solution is worked up in known manner, 14.9 g of N-(α-ethoxyethyl)-acetamide (boiling point 81°C/0.66 mbar; $n_D^{25}$ = 1.4332) are obtained which correspond to a product yield of 75.6% and a current efficiency of 62.9%. At an average cell voltage of 68.9 volts, an energy expenditure of 44.4 kWh/kg of product can be calculated on account of the above dates.

EXAMPLES 11

In an electrolysis cell according to Example 1, a solution of 39.9 g of N-acetyl-α-alanine and 111.2 g of i-butanol, partially neutralized by means of NaOH to the extent of 40%, is electrolyzed at a current density of 5.4 A/dm² and a temperature of 0°C with agitation by means of a magnetic agitator at 30 to 35 r.p.m. After a current quantity of 0.647 Faraday is passed through the cell and the electrolysis solution is worked up in known manner, 31.1 g of N-(α-i-butoxyethyl)-acetamide (boiling point 83° – 84°C/0.33 mbar; melting point 59° – 61°C; $n_D^{61} = 1.4209$) are obtained which correspond to a product yield of 65.1% and a current efficiency of 59.2%. At an average cell voltage of 81.5 volts, an energy expenditure of 45.4 kWh/kg of product can be calculated on account of the above dates.

EXAMPLE 12

In an electrolysis cell according to Example 1, a solution of 28.3 g of N-(n-butyroyl)-α-alanine and 85.3 g of methanol, partially neutralized by sodium to the extent of 20%, is electolyzed at a current density of 5.4 A/dm² and a temperature of 0°C with agitation by means of a magnetic agitator at 30 to 35 r.p.m. After a current quantity of 0.534 Faraday is passed through the cell and the electrolysis solution is worked up in known manner, 22.8 g of N-(α-methoxyethyl)-n-butyramide (boiling point 81°–84°C/0.33 mbar; $n_D^{25} = 1.4382$) are obtained which correspond to a product yield of 86.6% and a current efficiency of 57.7%. At an average cell voltage of 14.4 volts, an energy expenditure of 9.0 kWh/kg of product can be calculated on account of the above dates.

What is claimed is:

1. A process for the preparation of N-(α-alkoxyethyl)-carboxylic acid amides which comprises partially neutralizing an N-acyl-α-aminopropionic acid to convert from 3 to 50 mole % of the acid groups thereof to alkali metal salt groups, preparing an alcoholic solution of said partially neutralized N-acyl-α-aminopropionic acid and electrolyzing said solution to convert said partially neutralized N-acyl-α-aminopropionic acid into an N-(α-alkoxyethyl)-carboxylic acid amide.

2. A process for making an N-(α-alkoxyethyl)-carboxylic acid amide of the formula

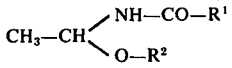

(I)

wherein $R^1$ is hydrogen or lower alkyl and $R^2$ is lower alkyl, which comprises forming a solution in an alcohol of the formula $R^2OH$ wherein $R^2$ is as defined above, of a partially neutralized N-acyl-α-aminopropionic acid of the formula

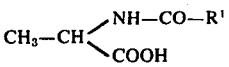

(II)

wherein $R^1$ is as defined above, said N-acyl-α-aminopropionic acid being partially neutralized by conversion of 3 to 50 mole % of the carboxyl groups thereof to alkali metal salt groups, the molar ratio of partially neutralized N-acyl-α-aminopropionic acid to said alcohol being from 1:2 to 1:50, and electrolyzing said partially neutralized N-acyl-α-aminopropionic acid in an electronic cell containing static electrodes and a stagnant or flowing electrolyte to produce said alkoxyethyl carboxylic acid amide.

3. A process as claimed in claim 2 wherein 5 to 20 mole % of the acid groups of the compound of formula II are converted to alkali metal salt groups.

4. A process as claimed in claim 2 wherein the electrolysis is carried out at a temperature from −10° to +100°C.

5. A method according to claim 2 wherein the N-acyl group of said N-acyl-α-aminopropionic acid is an acetamide group.

6. A method according to claim 2 wherein the N-acyl group of said N-acyl-α-aminopropionic acid is a formamide group.

7. A method according to claim 2 wherein said alcohol is methanol.

8. A method according to claim 2 wherein said alcohol is ethanol.

9. A method according to claim 2 wherein said alcohol is isobutanol.

10. A method according to claim 2 wherein the N-acyl group of said N-acyl-α-aminopropionic acid is a butyramide group.

11. A method according to claim 2 wherein a current density of 2 to 100 A/dm² is used.

* * * * *